US010985004B2

(12) United States Patent
Kudo

(10) Patent No.: US 10,985,004 B2
(45) Date of Patent: Apr. 20, 2021

(54) MASS SPECTROMETER

(71) Applicant: SHIMADZU CORPORATION, Kyoto (JP)

(72) Inventor: Tomoya Kudo, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/625,956

(22) PCT Filed: Jul. 18, 2017

(86) PCT No.: PCT/JP2017/025922

§ 371 (c)(1),
(2) Date: Dec. 23, 2019

(87) PCT Pub. No.: WO2019/016854

PCT Pub. Date: Jan. 24, 2019

(65) Prior Publication Data

US 2020/0161118 A1 May 21, 2020

(51) Int. Cl.

| | |
|---|---|
| ***H01J 49/24*** | (2006.01) |
| ***H01J 49/40*** | (2006.01) |
| ***H01J 49/04*** | (2006.01) |

(52) U.S. Cl.

CPC ..... *H01J 49/24* (2013.01); *H01J 49/04* (2013.01); *H01J 49/0495* (2013.01); *H01J 49/40* (2013.01)

(58) Field of Classification Search

CPC .. H01J 49/24; H01J 49/40; H01J 49/04; H01J 49/0495

(Continued)

(56) References Cited

U.S. PATENT DOCUMENTS

| | | | |
|---|---|---|---|
| 4,709,148 | A | 11/1987 | Meddings |
| 6,465,777 | B1 | 10/2002 | Rache |

(Continued)

FOREIGN PATENT DOCUMENTS

| | | | |
|---|---|---|---|
| CA | 1 213 081 | A | 10/1986 |
| CA | 2 616 843 | A1 | 4/2007 |

(Continued)

OTHER PUBLICATIONS

International Search Report for PCT/JP2017/025922 dated Oct. 17, 2017 [PCT/ISA/210].

(Continued)

*Primary Examiner* — Kiet T Nguyen
(74) *Attorney, Agent, or Firm* — Sughrue Mion, PLLC

(57) ABSTRACT

A mass spectrometer (10) includes a housing (19) that houses a plurality of devices including a mass analyzer (110) including an ionization unit, a mass separation unit, and an ion detection unit, a first heat generation device (11), and a second heat generation device (12) which has an allowable maximum temperature lower than that of the first heat generation device (11) or an allowable temperature variation amount smaller than that of the first heat generation device (11), an intake port (14) of the housing (19) which is provided at a position closer to the second heat generation device (12) with respect to the first heat generation device (11), and an exhaust fan (15) of the housing (19) which is provided at a position farther from the second heat generation device (12) with respect to the first heat generation device (11).

5 Claims, 3 Drawing Sheets

(58) Field of Classification Search
USPC ..... 250/281
See application file for complete search history.

(56) References Cited

U.S. PATENT DOCUMENTS

| | | | | |
|---|---|---|---|---|
| 2007/0071646 | A1 | 3/2007 | Schoen et al. | |
| 2012/0248305 | A1 | 10/2012 | Noda et al. | |
| 2013/0068946 | A1* | 3/2013 | Moskovets | H01J 49/0468 250/288 |
| 2014/0084154 | A1* | 3/2014 | Bazhenov | H01J 49/044 250/288 |

FOREIGN PATENT DOCUMENTS

| | | | |
|---|---|---|---|
| CN | 102737951 | A | 10/2012 |
| EP | 2 506 286 | A2 | 10/2012 |
| FR | 2 577 072 | A1 | 8/1986 |
| GB | 2 170 930 | A | 8/1986 |
| GB | 2 338 824 | A | 12/1999 |
| JP | 2012-216339 | A | 11/2012 |
| WO | 2007/041165 | A2 | 4/2007 |

OTHER PUBLICATIONS

Written Opinion of the International Searching Authority for PCT/JP2017/025922 dated Oct. 17, 2017 [PCT/ISA/237].

* cited by examiner

PLAN VIEW

SIDE VIEW

MASS SPECTROMETER

CROSS REFERENCE TO RELATED APPLICATIONS

This application is a National Stage of International Application No. PCT/JP2017/025922 filed Jul. 18, 2017.

TECHNICAL FIELD

The present invention relates to a mass spectrometer, and in particular, a configuration for cooling devices that generate heat such as a vacuum pump and a power supply (hereafter, these are referred to as heat generation devices) among devices other than a device that performs ionization and mass spectrometry of a sample (hereinafter referred to as a "mass analyzer") of mass spectrometers.

BACKGROUND ART

In a mass spectrometer, it is necessary to evacuate an ionization chamber that ionizes a sample and an analysis chamber that performs mass spectrometry. Therefore, the mass spectrometer is provided with a vacuum pump, and a turbo molecular pump that can easily obtain a high degree of vacuum is often used particularly in the final stage. Further, the mass spectrometer is provided with a power supply for supplying power used for ionization and analysis and power for operating the vacuum pump. Since the current, voltage, and frequency are different for each application, a plurality of power supplies is usually provided in one mass spectrometer. In general, these vacuum pump and power supplies are housed in a housing of a mass spectrometer together with main bodies including an ionization chamber and an analysis chamber.

The turbo molecular pump is a pump that exhausts gas by blowing off gas molecules by rotating the rotor blades at high speed. When the temperature rises higher than a predetermined allowable temperature during use, the rotor blades expand and deform with heat, and the rotor blade may be damaged. In addition, when the temperature of the power supply rises, the output voltage varies, causing the deterioration of the analysis accuracy. Furthermore, the turbo molecular pump, other vacuum pumps and power supplies, as heat sources, raise the temperature of peripheral devices, thereby reducing the analysis accuracy and causing malfunctions of these devices. For these reasons, in the mass spectrometer, it is necessary to cool the heat generation devices such as a vacuum pump and a power supply and their surroundings during operation.

Patent Literature 1 describes a mass spectrometer in which an intake port and an exhaust fan are provided in a housing, and an exhaust fan is disposed near a turbo molecular pump in the housing. In addition to the configuration in which the intake port and the exhaust fan are combined, a configuration in which the intake fan and the exhaust port are combined is also conceivable. The former has a negative pressure inside the housing by exhausting the air with an exhaust fan, so that it is excellent in that the air flow from the intake port to the exhaust fan is easily generated, and the inside of the housing can be cooled evenly.

CITATION LIST

Patent Literature

Patent Literature 1: U.S. Pat. No. 6,465,777 B1

SUMMARY OF INVENTION

Technical Problem

However, in the configuration in which the intake port and the exhaust fan are combined, it is difficult to increase the wind speed of the air in the housing, and it is difficult to greatly improve the cooling capacity. For this reason, it may be impossible to cool a heat generation device such as a vacuum pump or a power supply to an allowable temperature only with a cooling mechanism that combines the intake port and the exhaust fan. Therefore, in addition to the intake port and the exhaust fan, a fan for local cooling is additionally provided in the vicinity of the heat generation device. However, when such a fan is additionally installed, there is a problem that the cost increases and noise increases. In addition, since the fan has a moving part, it easily breaks down in the devices constituting the mass spectrometer. Therefore, the additional fan increases the frequency of failure, and the reliability of the device decreases. Furthermore, vibration is generated from the fan, and the vibration is propagated to the mass analyzer, which may reduce the analysis accuracy.

In addition, for example, the power supply used for applying a voltage to the electrode arranged at a position through which ions pass, generates heat, and when the ambient temperature changes, the output voltage varies, so that the mass resolution and mass accuracy of the mass spectrometer deteriorate, and are easily affected by heat. Therefore, it is required to make the change in the surrounding temperature smaller for such a power supply than for other components of the mass spectrometer.

An object of the present invention is to provide a mass spectrometer that can improve a performance of cooling a heat generation device and can suppress a temperature variation around the heat generation device that is sensitive to a temperature variation.

Solution to Problem

A mass spectrometer according to the present invention which has been made to solve the above problems includes a) a housing configured to house a plurality of devices including a mass analyzer including an ionization unit, a mass separation unit and an ion detection unit, b) a first heat generation device which is one of the devices and a second heat generation device which is one of the devices, the second heat generation device having an allowable maximum temperature lower than an allowable maximum temperature of the first heat generation device or an allowable temperature variation amount smaller than an allowable temperature variation amount of the first heat generation device.

c) an intake port of the housing provided at a position closer to the second heat generation device with respect to the first heat generation device, and d) an exhaust fan of the housing provided at a position farther from the second heat generation device with respect to the first heat generation device.

The wind speed of the air in the vicinity of the intake port of the housing is higher than that inside of the housing, and the air before being heated by the mass analyzer and its attached devices in the housing passes, so that it has the ability to cool the device. Therefore, in the present invention, when a second heat generation device whose allowable maximum temperature is lower than that of the first heat generation device is used, by disposing the second heat generation device closer to the intake port with respect to the first heat generation device, the performance to cool the second heat generation device can be increased, and the second heat generation device can be less affected by the first heat generation device.

As a result, it is not necessary to add a fan for local cooling to the heat generation device, and the number of fans in the mass spectrometer can be reduced, so that an increase in cost and an increase in noise can be reduced, and the reliability of the mass spectrometer is increased.

Examples of the second heat generation device include a vacuum pump such as a turbo molecular pump and a power supply for applying a voltage to a component sensitive to the variation in output voltage such as an electrode provided in a portion through which ions of the mass spectrometer pass. Examples of the first heat generation device include an ionization unit, a mass separation unit excluding a TOF unit, an ion detection unit, and a DC switching power supply that supplies power to the electric board.

The exhaust fan is usually provided with an opening having an area set according to its capacity. When the opening area of the intake port is too large relative to the area of the opening of the exhaust fan, the air volume of the exhaust fan can be secured, but the wind speed of the air is too slow. On the other hand, when the opening area of the intake port is too small relative to the area of the opening of the exhaust fan, the air volume is insufficient due to pressure loss. Therefore, it is preferable that the opening area of the intake port be about the same as the opening area of the exhaust fan, specifically 0.3 to 7 times the area of the opening of the exhaust fan.

The mass spectrometer according to the present invention may include a plurality of the intake ports, and a second heat generation device may be disposed, for each of the plurality of the intake ports, at a position, in the housing, closer to the intake port with respect to the first heat generation device. Thereby, each second heat generation device can be cooled more reliably. In this case, it is preferable that the sum of the opening areas of the plurality of the intake ports be 0.3 to 7 times the opening area of the exhaust fan.

In the mass spectrometer according to the present invention, the second heat generation device is preferably disposed at a position higher than the position of the intake port and the position of the first heat generation device, and the exhaust fan is preferably disposed at a position higher than the position of the second heat generation device. As a result, since the air that has been warmed and lightened by cooling the second heat generation device passes above the first heat generation device and is discharged from the exhaust fan to the outside of the housing, the first heat generation device is not exposed to the air warmed by the second heat generation device, so that the temperature rise of the first heat generation device can be prevented more effectively.

Advantageous Effects of Invention

According to the mass spectrometer according to the present invention, it is possible to improve the performance of cooling a heat generation device and to suppress a temperature change around a heat generation device that is sensitive to a temperature variation.

DESCRIPTION OF EMBODIMENTS

Embodiments of a mass spectrometer according to the present invention will be described with reference to FIGS. 1 to 5.

Figure 1A:
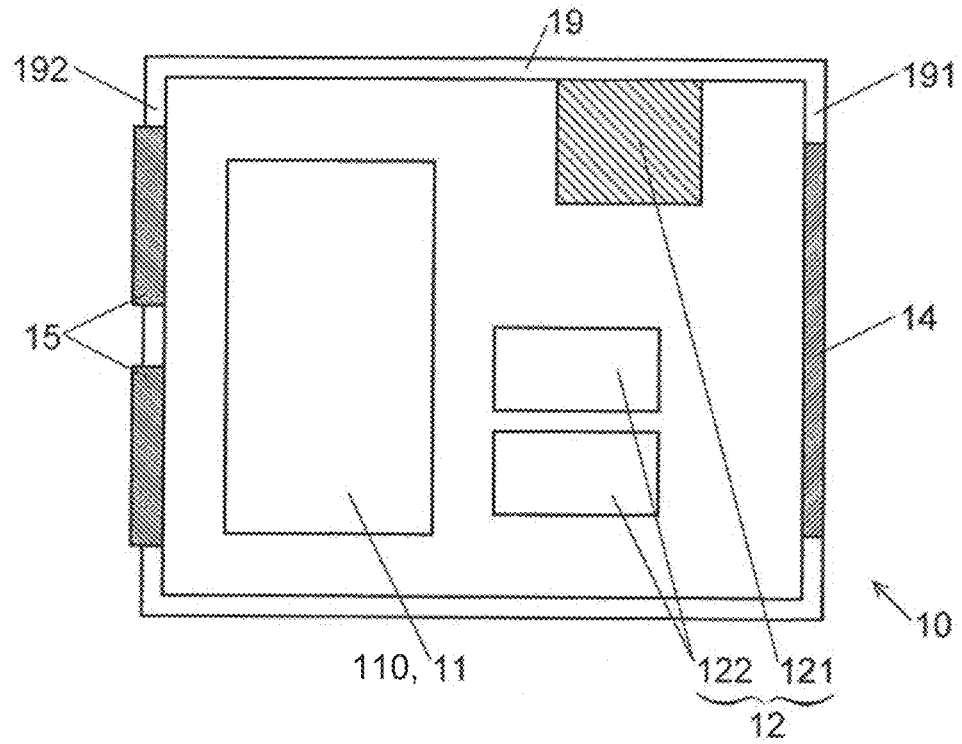
FIGS. 1A and 1B are a plan view and a side view, respectively, showing an arrangement of a mass analyzer, a turbo molecular pump, and a power supply in a first embodiment of a mass spectrometer according to the present invention.
Figure 1B:
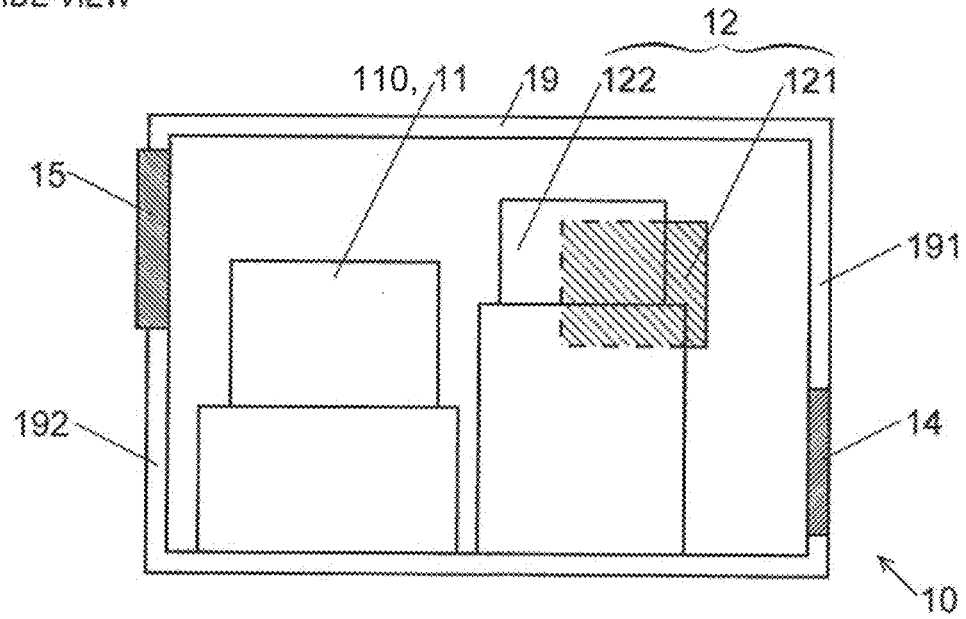

As shown in FIGS. 1A and 1B, a mass spectrometer 10 of a first embodiment includes a mass analyzer 110, a turbo molecular pump 121 that is a vacuum pump, a power supply 122, and a housing 19 that houses them.

Figure 2:
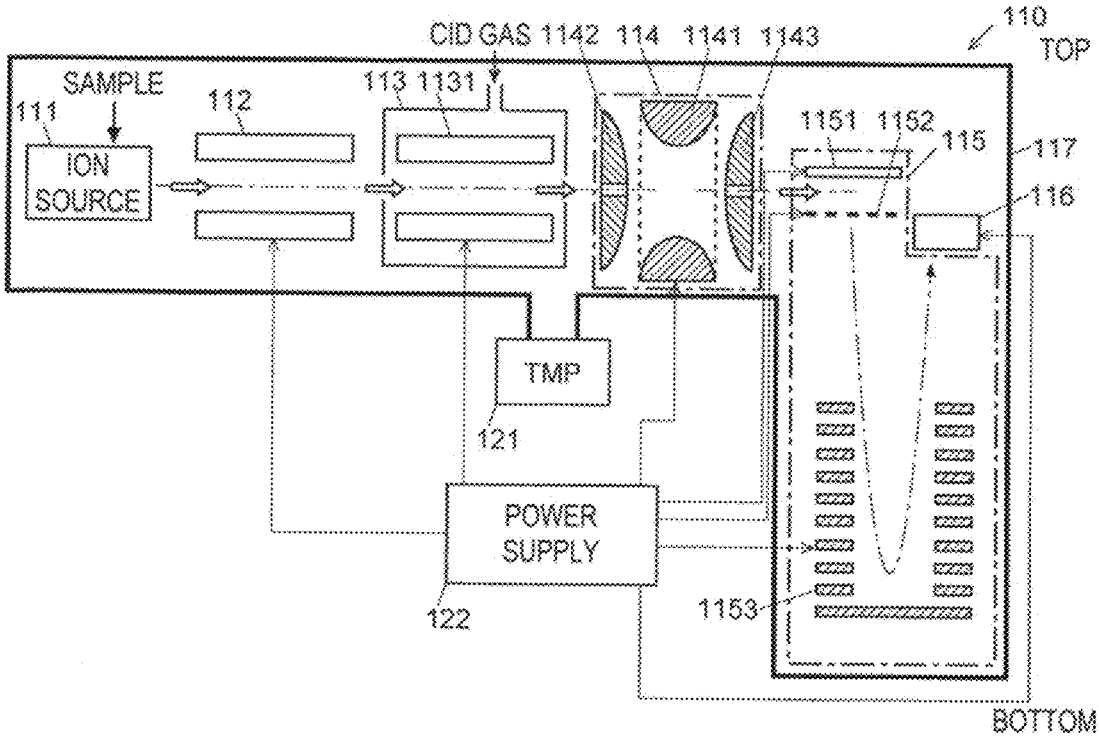
FIG. 2 is a schematic configuration diagram showing the mass analyzer included in the mass spectrometer of the first embodiment.

As shown in FIG. 2, the mass analyzer 110 includes a vacuum chamber 117 in which an ion source 111, a quadrupole mass filter 112, a collision cell 113, an ion trap 114, a time-of-flight mass separator 115, and an ion detector 116 are arranged. The ion source 111 ionizes various compounds contained in the sample. The quadrupole mass filter 112 passes only precursor ions having a specific mass-to-charge ratio specified in advance. The collision cell 113 cleaves precursor ions and includes an ion guide 1131 in its inside. The ion trap 114 captures a product ion produced by cleavage and a precursor ion that has not been cleaved, and then ejects them in a packet form, and includes a ring electrode 1141 and a pair of end cap electrodes 1142 and 1143 that is provided with the ring electrode interposed between them. The time-of-flight mass separator 115 applies a certain acceleration energy to ions and flies the ions a certain distance to cause the ion detector 116 to detect the ions, so that it calculates the mass-to-charge ratio of the ions from the time required for the flight. The time-of-flight mass separator 115 includes an expulsion electrode 1151 and a grid electrode 1152 that accelerate ions in a direction (downward) perpendicular to the traveling direction so far, and a reflective electrode (reflectron) 1153 for reflecting the accelerated ions after flying the ions a predetermined distance. The power supply 122 is connected to respective electrodes included in the quadrupole mass filter 112, the collision cell 113, the ion trap 114, the time-of-flight mass separator 115, and the ion detector 116, the ion detector 116, and the like, and power is supplied to respective components. The vacuum chamber 117 is connected to the turbo molecular pump 121, and its inside is maintained at a high vacuum. The mass analyzer 110 shown here is an example, and various mass analyzers can be used in the present invention.

As shown in FIGS. 1A and 1B, the housing 19 has a rectangular parallelepiped shape, an intake port 14 is also provided in an intake port installation face 191 that is one of the four side surfaces of the rectangular parallelepiped, and a plurality of exhaust fans 15 is arranged on an exhaust fan installation face 192 side by side so as to occupy most of the exhaust fan installation face 192, in the width direction, that is a side surface facing the intake port installation face 191.

The opening area of the intake port 14 is preferably 0.3 to 7 times the opening area of the exhaust fans 15, and is the same as the opening area of the exhaust fans 15 in the first embodiment.

Usually, a commercially available turbo molecular pump is provided with a fan for cooling itself. However, the turbo molecular pump 121 used in the mass spectrometer 10 of the first embodiment is not provided with a fan, and it is cooled only by the cooling mechanism that combines the intake port 14 and the exhaust fans 15 provided in the housing 19.

The exhaust fans 15, the power supply 122, the turbo molecular pump 121, a device other than the turbo molecular pump 121 and the power supply 122 (a first heat generation device 11 described later), the intake port 14 are arranged from top to bottom with respect to the height direction.

The mass spectrometer 10 of the first embodiment operates the exhaust fans 15 to have a negative pressure inside of the housing 19, whereby external air is introduced into the housing 19 from the intake port 14. The cooling mechanism that combines the intake port 14 and the exhaust fans 15 generates air flow in the housing 19 more easily than the cooling mechanism that combines the intake fan and the exhaust port, and cools the interior of the housing 19 evenly.

The turbo molecular pump 121 and the power supply 122 correspond to a heat generation device whose allowable maximum temperature is lower than that of another device (the first heat generation device 11) in the mass spectrometer 10 of the first embodiment or that is sensitive to ambient temperature variations, that is, the above second heat generation device. Hereinafter, the turbo molecular pump 121 and the power supply 122 are collectively referred to as a "second heat generation device 12". The intake port 14 is provided at a position closer to the second heat generation device 12 with respect to the first heat generation device 11, and the exhaust fans 15 is provided at a position farther from the second heat generation device 12 with respect to the first heat generation device 11. Therefore, the air introduced into the housing 19 from the intake port 14 passes through the second heat generation device 12 at a wind speed faster than that at the position of the first heat generation device 11, so that the second heat generation device 12 can be efficiently cooled.

In the mass spectrometer 10 of the first embodiment, the second heat generation device 12 is disposed at a position higher than positions of the intake port 14 and the first heat generation device 11, and further, the exhaust fans 15 is disposed at a position higher than positions of the first heat generation device 11 and the second heat generation device 12, so that air that has been warmed and lightened by cooling the second heat generation device 12 passes above the first heat generation device 11 and is discharged from the exhaust fans 15 to the outside of the housing 19. Therefore, the first heat generation device 11 is not exposed to the air warmed by the second heat generation device 12, and the temperature rise of the first heat generation device 11 can be more effectively prevented. The first heat generation device 11 is cooled by the passage of air that has been introduced from the intake port 14 and has passed below the second heat generation device 12.

Figure 3:
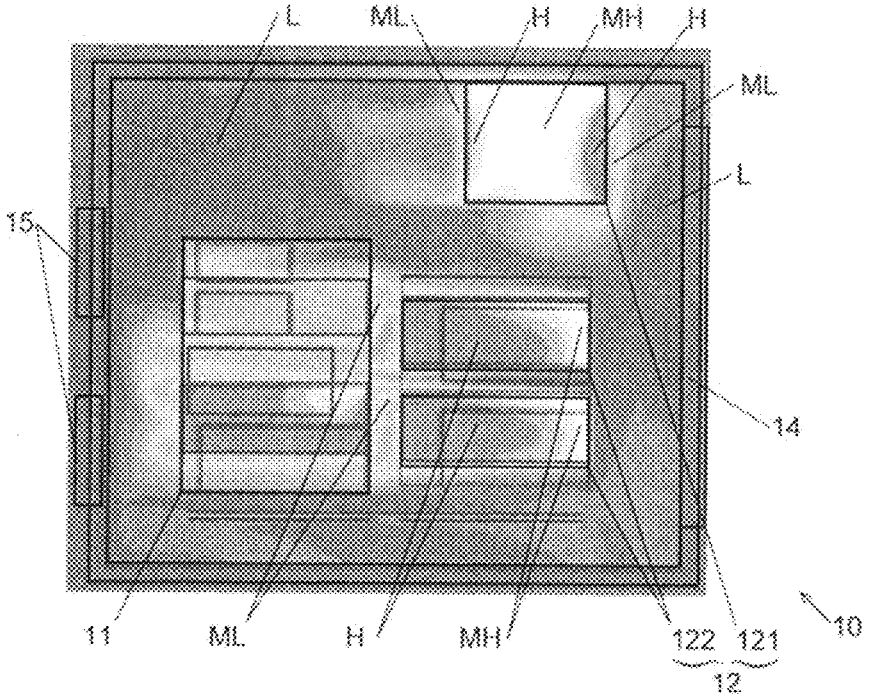
FIG. 3 is a plan view of a temperature distribution in a housing obtained by calculation for the mass spectrometer of the first embodiment.
Figure 4:
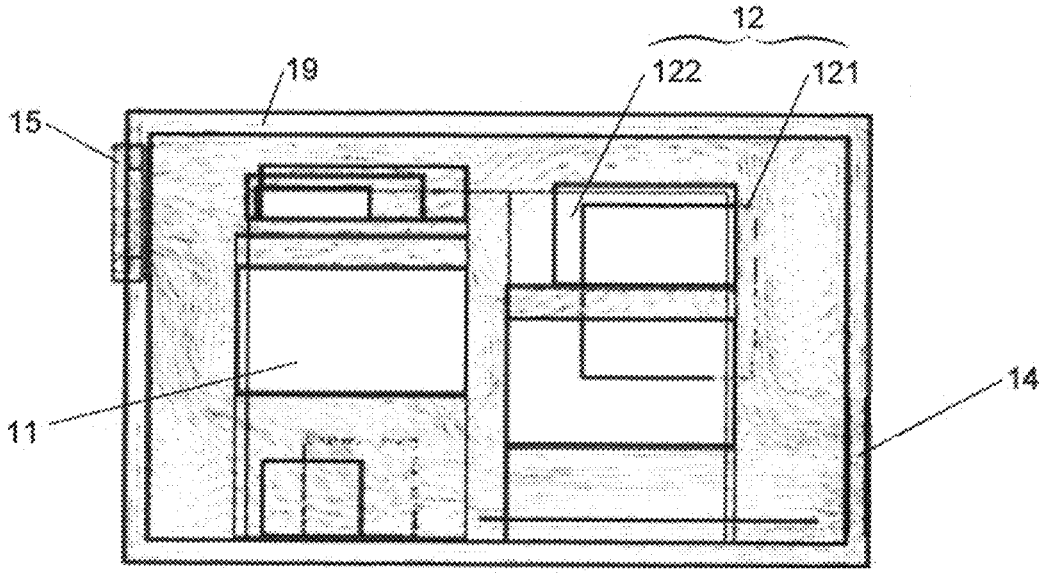
FIG. 4 is a side view of air flow velocity distribution obtained by calculation for the mass spectrometer of the first embodiment.

For the mass spectrometer 10 of the first embodiment, the temperature distribution and the air flow velocity distribution in the housing 19 were calculated. For the results, FIG. 3 shows the temperature distribution in plan view and FIG. 4 shows the air flow velocity distribution in side view. The temperature is high ("H" in FIG. 3) or relatively higher ("MH" in FIG. 3) in the turbo molecular pump 121 and the power supply 122, and is relatively low ("ML" in FIG. 3) around the turbo molecular pump 121 and the power supply 122, in the region near the exhaust fans 15 which is air downstream of the power supply 122, and in the region where the first heat generation device 11 exists, and is low in the other regions ("L" in FIG. 3). In the entire housing 19, the temperature exhibits a distribution that is nearly uniform except for the position where the second heat generation device 12 is disposed. The air flow velocity in the vicinity of the intake port 14 and the exhaust fans 15 is higher than that in the other positions. In particular, the vicinity of the intake port 14 can be cooled with air before being heated by the other heat generation devices, so that the above devices are arranged to be suitable for cooling the second heat generation device 12 disposed closer to the intake port 14 with respect to the first heat generation device 11.

Figure 5:
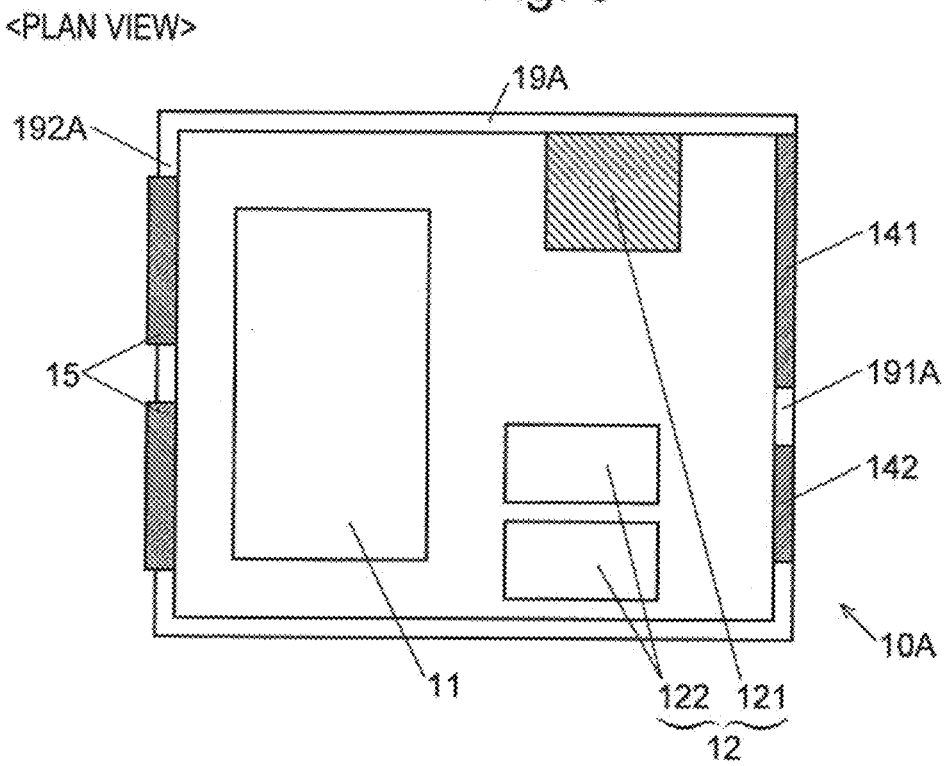
FIG. 5 is a plan view showing an arrangement of a mass analyzer, a turbo molecular pump, and a power supply in a second embodiment of the mass spectrometer according to the present invention.

A second embodiment of the mass spectrometer according to the present invention will be described with reference to FIG. 5. A mass spectrometer 10A of the second embodiment includes the turbo molecular pump 121 and the power supply 122 (the second heat generation device 12) similar to those of the mass spectrometer 10 of the first embodiment, and the first heat generation device 11 which is another device which are housed in a rectangular parallelepiped housing 19A. Two intake ports, that is, the first intake port 141 and the second intake port 142, are provided, at the same height, in an intake port installation face 191A, which is one of the four side faces of the housing 19A. The turbo molecular pump 121 is disposed at a position closer to the first intake port 141 with respect to the first heat generation device 11 and the power supply 122. On the other hand, the power supply 122 is disposed at a position closer to the second intake port 142 with respect to the first heat generation device 11 and the turbo molecular pump 121. The exhaust fans 15 similar to those of the mass spectrometer 10 of the first embodiment are provided in an exhaust fan installation face 192A that is a side face, of the housing 19A, that faces the intake port installation face 191A. The positional relationship in the height direction between the first heat generation device 11, the turbo molecular pump 121, the power supply 122, the intake ports (the first intake port 141 and the second intake port 142), and the exhaust fans in the mass spectrometer of the second embodiment is the same as that in the mass spectrometer 10 of the first embodiment.

The area of the first intake port 141 is larger than the area of the second intake port 142. The sum of the areas of the first intake port 141 and the second intake port 142 is preferably 0.3 to 7 times the opening area of the exhaust fans 15, and is the same as the opening area of the exhaust fans 15 in this embodiment.

In the mass spectrometer 10A of the second embodiment, the first intake port 141 is provided at a position closer to the turbo molecular pump 121 with respect to the first heat generation device 11, and the second intake port 142 is provided at a position closer to the power supply 122 with respect to the first heat generation device 11. For this reason, the air introduced into the housing 19 from the first intake port 141 passes through the turbo molecular pump 121 at a wind speed faster than that at the position of the first heat generation device 11, and the air introduced into the housing 19 from the second intake port 142 passes through the power supply 122 at a wind speed faster than that at the position of the first heat generation device 11, so that the turbo molecular pump 121 and the power supply 122 that are the second heat generation device 12 can be efficiently cooled. In addition, since the first intake port 141 has a larger area than the second intake port 142, the turbo molecular pump 121 having a larger heat value than the power supply 122 is supplied with a larger amount of air, thereby being more efficiently cooled.

Needless to say, the present invention is not limited to the above-described embodiments, and various modifications are possible.

REFERENCE SIGNS LIST

10, 10A . . . Mass Spectrometer
11 . . . First Heat Generation Device
110 . . . Mass Analyzer
111 . . . Ion Source
112 . . . Quadrupole Mass Filter
113 . . . Collision Cell
1131 . . . Ion Guide
114 . . . Ion Trap
1141 . . . Ring Electrode
1142 . . . End Cap Electrode
115 . . . Time-Of-Flight Mass Separator
1151 . . . Expulsion Electrode
1152 . . . Grid Electrode
116 . . . Ion Detector
117 . . . Vacuum Chamber
12 . . . Second Heat Generation Device
121 . . . Turbo Molecular Pump
122 . . . Power Supply
14 . . . Intake Port
141 . . . First Intake Port
142 . . . Second Intake Port
15 . . . Exhaust Fan
19, 19A . . . Housing
191, 191A . . . Intake Port Installation Face
192, 192A . . . Exhaust Fan Installation Face
192A . . . Exhaust Fan Installation Face

The invention claimed is:

1. A mass spectrometer comprising:

a housing configured to house a plurality of devices including a mass analyzer including an ionization unit, a mass separation unit, and an ion detection unit;

a first heat generation device which is one of the devices;

a second heat generation device which is one of the devices, the second heat generation device having an allowable maximum temperature lower than an allowable maximum temperature of the first heat generation device or an allowable temperature variation amount smaller than an allowable temperature variation amount of the first heat generation device and being disposed at a position higher than a position of the first heat generation device;

an intake port, of the housing provided at a position closer to the second heat generation device with respect to the first heat generation device and disposed at a position lower than a position of the second heat generation device; and an exhaust fan, of the housing provided at a position farther from the second heat generation device with respect to the first heat generation device and disposed at a position higher than the position of the second heat generation device.

2. The mass spectrometer according to claim 1, wherein the second heat generation device does not include a fan for local cooling.

3. The mass spectrometer according to claim 1, wherein an opening area of the intake port is 0.3 to 7 times an opening area of the exhaust fan.

4. The mass spectrometer according to claim 1, wherein the mass spectrometer includes a plurality of the intake ports, and a second heat generation device is disposed, for each of the plurality of the intake ports, at a position, in the housing, closer to the intake port with respect to the first heat generation device.

5. The mass spectrometer according to claim 4, wherein a sum of opening areas of the plurality of intake ports is 0.3 to 7 times an opening area of the exhaust fan.

* * * * *